US010513899B2

(12) United States Patent
Cherewyk

(10) Patent No.: US 10,513,899 B2
(45) Date of Patent: Dec. 24, 2019

(54) DEBRIS CATCHER

(71) Applicant: ISOLATION EQUIPMENT SERVICES, INC., Red Deer (CA)

(72) Inventor: Boris (Bruce) P. Cherewyk, Calgary (CA)

(73) Assignee: ISOLATION EQUIPMENT SERIVCES INC., Calgary (CA)

( * ) Notice: Subject to any disclaimer, the term of this patent is extended or adjusted under 35 U.S.C. 154(b) by 137 days.

(21) Appl. No.: 15/812,654

(22) Filed: Nov. 14, 2017

(65) Prior Publication Data

US 2018/0135371 A1 May 17, 2018

Related U.S. Application Data

(60) Provisional application No. 62/422,351, filed on Nov. 15, 2016.

(51) Int. Cl.

| | |
|---|---|
| ***E21B 27/00*** | (2006.01) |
| ***E21B 21/00*** | (2006.01) |
| ***E21B 41/00*** | (2006.01) |

(52) U.S. Cl.

CPC ..... *E21B 27/005* (2013.01); *E21B 21/002* (2013.01); *E21B 41/0021* (2013.01)

(58) Field of Classification Search

CPC ... E21B 27/005; E21B 41/0021; E21B 21/002
See application file for complete search history.

(56) References Cited

U.S. PATENT DOCUMENTS

| | | | | | |
|---|---|---|---|---|---|
| 834,431 | A * | 10/1906 | Williams | B01D 35/02 | 210/448 |
| 4,495,073 | A * | 1/1985 | Beimgraben | E21B 21/002 | 166/227 |
| 6,598,685 | B1 * | 7/2003 | Mashburn | E21B 21/002 | 166/227 |
| 7,243,742 | B2 * | 7/2007 | Kutryk | B01D 35/02 | 166/158 |
| 7,303,029 | B2 * | 12/2007 | Hall | E21B 17/003 | 166/65.1 |
| 7,980,330 | B1 * | 7/2011 | LeJeune | E21B 41/0021 | 166/227 |
| 9,095,799 | B1 * | 8/2015 | Packard | B01D 35/023 | |
| 2013/0306304 | A1 * | 11/2013 | Cherewyk | E21B 43/26 | 166/90.1 |
| 2017/0254180 | A1 * | 9/2017 | Romero | E21B 21/003 | |

* cited by examiner

*Primary Examiner* — Michael R Wills, III
(74) *Attorney, Agent, or Firm* — Parlee McLaws LLP (CGY); Sean Goodwin; Chi Fai Andrew Lau

(57) ABSTRACT

A debris catcher and system is provided for removing debris from fluids such as in wellbore stimulation operations. A generally tubular housing axially supports a tubular screen inside a housing bore. Debris-laden fluid flows from an intake end of the housing axially into the bore of the screen and exits screen openings radially into an axially elongated flow annulus formed between a tubular wall of the screen body and the housing bore. Debris is retained in the upstream portion of screen body and clean fluid, in the annulus, returns downstream of the screen for exit out a discharge end of the housing. The screen is removably installable to the housing.

21 Claims, 11 Drawing Sheets

DEBRIS CATCHER

CROSS-REFERENCE TO RELATED APPLICATIONS

This application claims the benefit of U.S. Provisional Patent application Ser. No. 62/422,351, filed Nov. 15, 2016, the entirety of which is incorporated herein by reference.

FIELD

The present disclosure relates to apparatus for removing solids from fluid streams. More particularly, a debris catcher with a flow-by basket screen is provided for capture of debris from flowback fluid returning from fracturing operations on a wellbore.

BACKGROUND

It is known to conduct fracturing or other stimulation procedures in a wellbore by isolating zones of interest, (or intervals within a zone), in the wellbore, using packers and the like, and subjecting the isolated zone to treatment fluids, including liquids and gases, at treatment pressures. In a typical fracturing procedure for a cased wellbore, for example, the casing of the well is perforated to admit oil and/or gas into the wellbore and fracturing fluid is then pumped into the wellbore and through the perforations into the formation. Such treatment opens and/or enlarges drainage channels in the formation, enhancing the producing ability of the well. For open holes that are not cased, stimulation is carried out directly in the zones or zone intervals. The fracturing fluid is recovered as flowback fluid from the well to be tested and treated before recycling or disposal.

In some forms of completion operations, after simulation, one or more bridge plugs remain in the well that isolate each stage or zone. Once fracturing operations have been completed, and before production operations can commence, the plugs or other isolation tools need to be drilled out, for example by using a drill bit on the end of a coil tubing unit.

The flowback fluid is directed to a testing system which monitors for quantity and type of returns, whether they be liquids, condensate, oil or gases. Large solids such as remnants of drilled out plugs and other debris are often entrained in the fluid produced from the wellbore. Such debris can plug and damage testing and other flowback equipment if not removed beforehand. Plugged flowback equipment can be very difficult to manage, and may necessitate a shut-down of the operation to clean out the flowback equipment of blocking debris. Accordingly, a plug or debris catcher is typically implemented upstream of the flowback equipment/components, which can include a manifold, valves, chokes, and tank vessels.

One solution, such as that provided by Cameron, a Schlumberger company, and depicted generally in FIG. 8, is to direct flowback fluids through a housing pipe containing a concentric internal screen with a plurality of orifices spaced about the tubular wall of the screen. The screen typically extends the length of the housing pipe and terminates at a closed end of the pipe, with an open opposite end for receiving flowback fluid. As the flowback fluid flows into the screen, large solids are contained therein while the fluid and smaller particulates are permitted to exit out of the orifices to an annular passage thereabout and flow downstream to an outlet pipe oriented generally orthogonally to the screen. Applicant has noted one characteristic with such a design is that the relatively stagnant orifices, other than the adjacent outlet pipe, have a tendency to become plugged by debris. As more orifices become plugged, the remaining available orifices can create a localized jetting action as fluid travels through, which can result in significant erosion and eventually compromise the wall of the equipment. Further, to accommodate the flow rate and progressive screen plugging, a large screen and surrounding pipe is provided, making the debris catching assembly unwieldy and the screens difficult to remove, clean, and replace due to their size. Additionally, orienting the outlet piping orthogonally to the screen results in a flow direction change and associated erosion.

SUMMARY

A debris catcher is provided herein for removing debris from fluid streams. Herein, a particular context is described for the removal of debris from flowback fluid. The embodiments herein result in a more uniform cleaned flow stream and improved screening of flowback fluids than heretofore available.

Embodiments of the debris catcher are implemented within a flowback system and each comprises a generally tubular housing having a housing bore extending axially therethrough and a tubular screen supported axially therein. The screen body comprises at least an axially extending basket screen having a screen bore defined by an open intake end, tubular wall, and end wall, the axis of the screen body being oriented generally in line with the direction of the flow of fluid and intake and discharge ends of the housing. The intake end of the housing bore is fluidly coupled with the intake end of the screen bore. Debris-laden fluid flows from an intake end of the housing into the screen bore, continues into an axially elongated flow annulus formed between the tubular wall of the screen body and the housing bore via a plurality of screen openings formed in the tubular wall, and out a discharge end of the housing. The plurality of screen openings retains large solids within the screen bore while permitting fluid communication between the screen bore and the flow annulus. In embodiments, the end wall of the basket screen can also have openings.

The screen body can be cantilevered from the housing, the end wall being spaced from the discharge end of the housing. In other embodiments, to allow for longer implementations of the screen, the screen body can be supported by the housing at both its intake and discharge ends, and/or at locations intermediate thereof.

In embodiments in which the screen body is supported by the housing at both intake and discharge ends, the end wall for the upstream debris-receiving portion is positioned upstream from a discharge portion of the screen comprising a downstream support structure and one or more discharge ports for forming a flow path for fluid from the flow annulus to the discharge end. Thus, fluid flows from the screen bore into the flow annulus, around the end wall, through the discharge ports, and exits via the discharge end of the housing. In such embodiments, the screen body can be relatively long compared to cantilevered embodiments, providing significant debris storage.

The generally in-line inlet and outlet openings of the debris catcher disclosed herein mitigates erosion compared to existing designs. Additionally, the elongate openings present substantially more cross-sectional flow area compared to the orifice designs of existing technologies, while still effectively removing debris. This mitigates the risk of plugging, and also allows fluid flow velocity to remain generally consistent even should some openings become plugged. The large combined flow area of the screen openings also mitigates risk of localized velocity increases and erosive jetting action. As the openings provide a large amount of flow area relative to existing screen units, the screen length can be made shorter than prior art screens, while maintaining effective flow area, thus allowing the debris catcher to be significantly more compact and facilitating ease of transportation, assembly, installation, removal, and maintenance. In embodiments wherein the screen body is supported at both its intake and discharge ends, a longer screen body is feasible, which provides even greater screening area and consequently allows for less frequent cleaning.

In a broad aspect, a debris catcher for removing debris from fluids comprises a generally tubular housing having an intake end, a discharge end, a housing bore extending axially therethrough, a tubular screen supported axially inside the housing bore and forming a flow annulus between the housing and the screen, the flow annulus in fluid communication with the discharge end, the screen comprising an upstream portion supported by the housing, the upstream portion having a tubular wall having a screen bore within, and having an intake end open to the housing's intake end and a downstream end wall, the tubular wall having a plurality of screen openings for establishing fluid communication between the screen bore and the flow annulus, wherein the screen openings pass fluid therethrough whilst retaining wellbore debris within the screen bore, a cumulative flow area of the screen openings being greater than a cross-sectional flow area of the intake end.

In embodiments, the screen's tubular wall at the intake end is cantilevered at the housing's intake end.

In embodiments, the screen's upstream portion further comprises a retaining structure at the intake end to secure the screen against axial movement within the housing bore.

In embodiments, the retaining structure comprises an upset at the intake end of the screen for engaging a corresponding shoulder of the housing intake end.

In embodiments, the retaining structure comprises a lip extending radially outwards from the tubular wall of the screen located adjacent the screen's intake end, and an annular shoulder about the housing's intake end, the lip engaging the shoulder for axially retaining the screen in the housing's bore.

In embodiments, the retaining structure comprises one or more annular grooves formed in the tubular wall of the upstream portion, one or more complementary holddown ports extending generally radially through the housing's intake end, each holddown port configured to receive a fastener to releasably engage the one or more annular grooves, such that the screen is removably secured axially within the housing bore.

In embodiments, the screen is receivable axially through either the housing intake end or discharge end.

In embodiments, the screen further comprises a discharge portion extending downstream from the end wall for support at the discharge end of the housing, the flow annulus and discharge end of the housing in fluid communication therethrough.

In embodiments, the discharge portion comprises a downstream support structure and one or more discharge ports for establishing fluid communication between the flow annulus and discharge end.

In embodiments, the discharge portion comprises tubular wall having the one or more discharge ports formed therethrough.

In embodiments, the discharge portion support structure is one or more prongs extending axially downstream from the end wall, the one or more discharge ports being formed between the one or more prongs.

In embodiments, the discharge support structure further comprising a ring circumferentially spanning the one or more prongs, the ring supported in the housing discharge end.

In embodiments, axes of the housing's intake and discharge ends are generally aligned with an axis of the tubular screen.

In embodiments, the plurality of screen openings in the upstream portion are elongate slots in the tubular wall.

In embodiments, the screen's end wall has a second plurality of openings for establishing communication between the screen bore and discharge end of the housing, the second plurality of openings retaining debris while allowing fluids to flow thereby.

In embodiments, the housing comprises at least a first housing portion and a second housing portion, removably coupled axially with each other.

In embodiments, the debris catcher further comprises one or more angularly spaced supports extending between the housing and the screen, located intermediate the intake and discharge ends for supporting the screen.

In another aspect, a manifold screen system for removing debris from fluids returned from a wellbore is provided, comprising an inlet flow block having a central bore in communication with two or more auxiliary bores, and at least two debris catchers, each debris catcher fluidly connected to one of the auxiliary bores of the inlet flow block, and isolated between two valves, for selectively permitting fluid flow to one or more of the at least two debris catchers.

In embodiments, the at least two debris catchers are spatially arranged to permit axial access to at least the intake end or the discharge end of each debris catcher for insertion or removal of a screen supported therein.

DESCRIPTION

In embodiments disclosed herein, a debris catcher is disclosed for connecting to a flow system which receives debris-laden fluid FD and retains large solids and debris within a screen body while allowing cleaned fluid FC to continue downstream.

In the context described herein, the fluid FD is a flow back fluid from a wellbore, such as fracturing fluid from the post-fracturing cleanup or testing stage. Flowback fluid FD, to be treated and tested, can be flowed out of the wellbore and passed through the debris catcher to remove large solids or debris therefrom. Examples of debris include remnants of drilled out isolation plugs and other cuttings. Fluid that has had the debris removed therefrom, or cleaned fluid FC, continues on to the rest of the flowback system for treatment and testing.

Additionally, a system is disclosed having two or more debris catchers in parallel for receiving flowback fluid FD, operated concurrently or alternately, with one catcher in operation while another is taken out of service for cleaning.

Figure 1A:
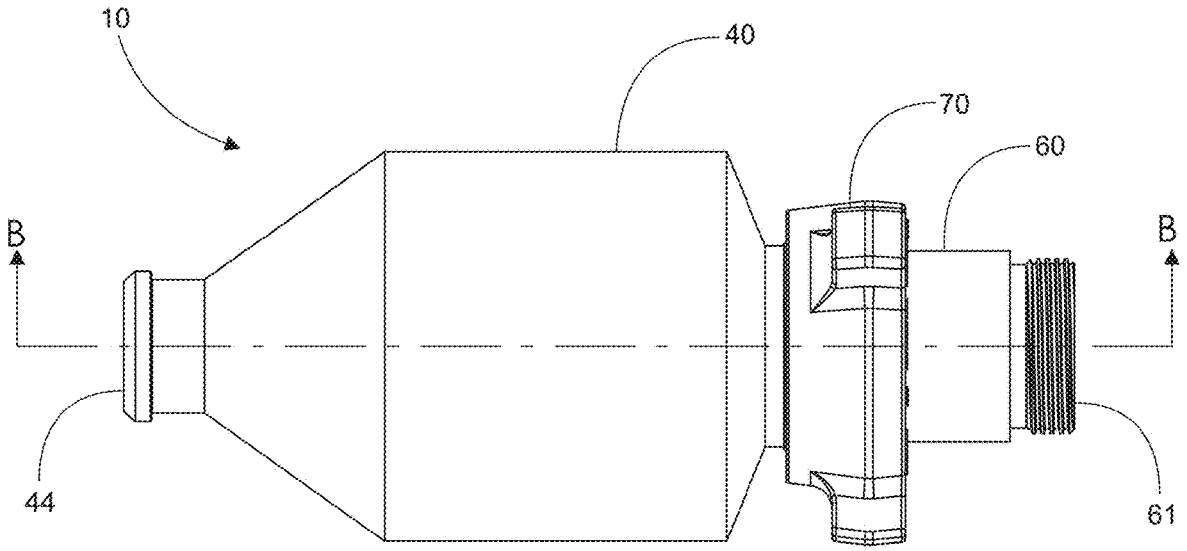
FIG. 1A is a side view of an embodiment of a debris catcher assembly.
Figure 1B:
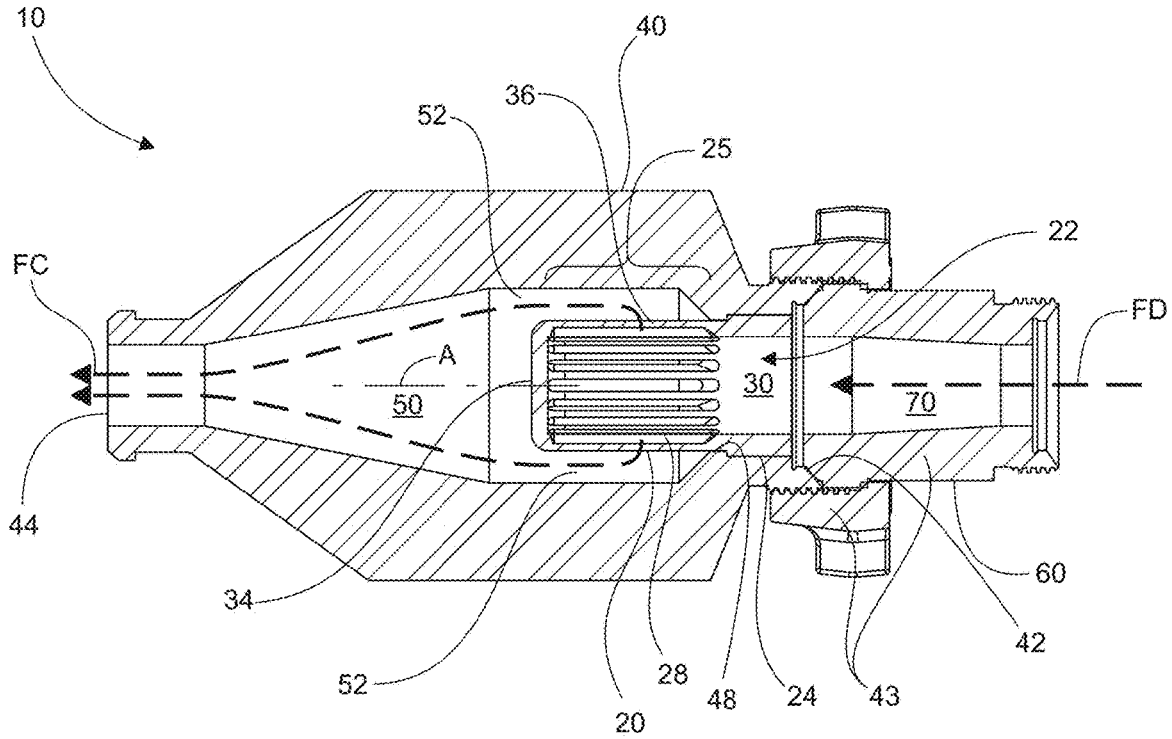
FIG. 1B is a side cross-sectional view of the embodiment of FIG. 1A along line A-A depicting a housing, inlet spool, screen, and a quick-connecting collar.

With reference to FIGS. 1A and 1B, in embodiments of a debris catcher 10, a tubular screen body 20 is supported and retained within an axial bore 50 of a tubular housing 40, forming an axially elongated flow annulus 52 therein between the screen body 20 and the housing 40. The screen body 20 comprises at least an upstream basket or debris-receiving portion 25 defining a screen bore 30 therein and having an axis A of which is oriented generally in-line with the housing's axial bore 50 and the generally axial flow of fluid FD. The basket portion 25 has a tubular screen wall 36 having a plurality of elongate screen openings 28 formed therethrough for permitting fluid communication between the screen bore 30 and flow annulus 52, an open intake end 22, and a downstream flow-restricting end wall 34 for directing at least a portion of the clean fluid FC through the screen openings 28. The end wall 34 of the basket portion 25 is spaced from the discharge end 44 of the housing 40, and more particularly, spaced from the end of the bore 50, for fluidly connecting the flow annulus 52 with the discharge end 44. The end wall 34 can also be fit with openings 27 (FIGS. 1B and 2B) to allow cleaned fluid FC to flow out to housing discharge end 44 while continuing to retain debris within screen bore 30.

Simply, a flow of fluid FD is received axially at the intake end 42 of the housing 40 and flows through the open intake end 22 of the screen body 20 and into the screen bore 30. Screen body 20 sealingly engages with the intake end 42 of the housing 40 in such a way that fluid FD flowing into the debris catcher 10 must travel into screen bore 30. Debris, larger than the openings 27,28, is caught in the screen bore 30 of debris-receiving basket portion 25 and retained therein whilst cleaned fluid FC continues through screen openings 27,28 to enter the flow annulus 52 and ultimately out of a discharge end 44 of the housing 40.

Inlet ends and outlet ends 42,44 of housing 40 can be generally axially aligned to mitigate the erosive effects associated with changes in flow direction. As shown in FIG. 1B, if desired, the housing bore 50 can gradually decrease in diameter toward an outlet end 44 to a diameter about equal to that of the respective downstream components, thereby further reducing erosion caused by the fluid F flowing therethrough.

Figure 2A:
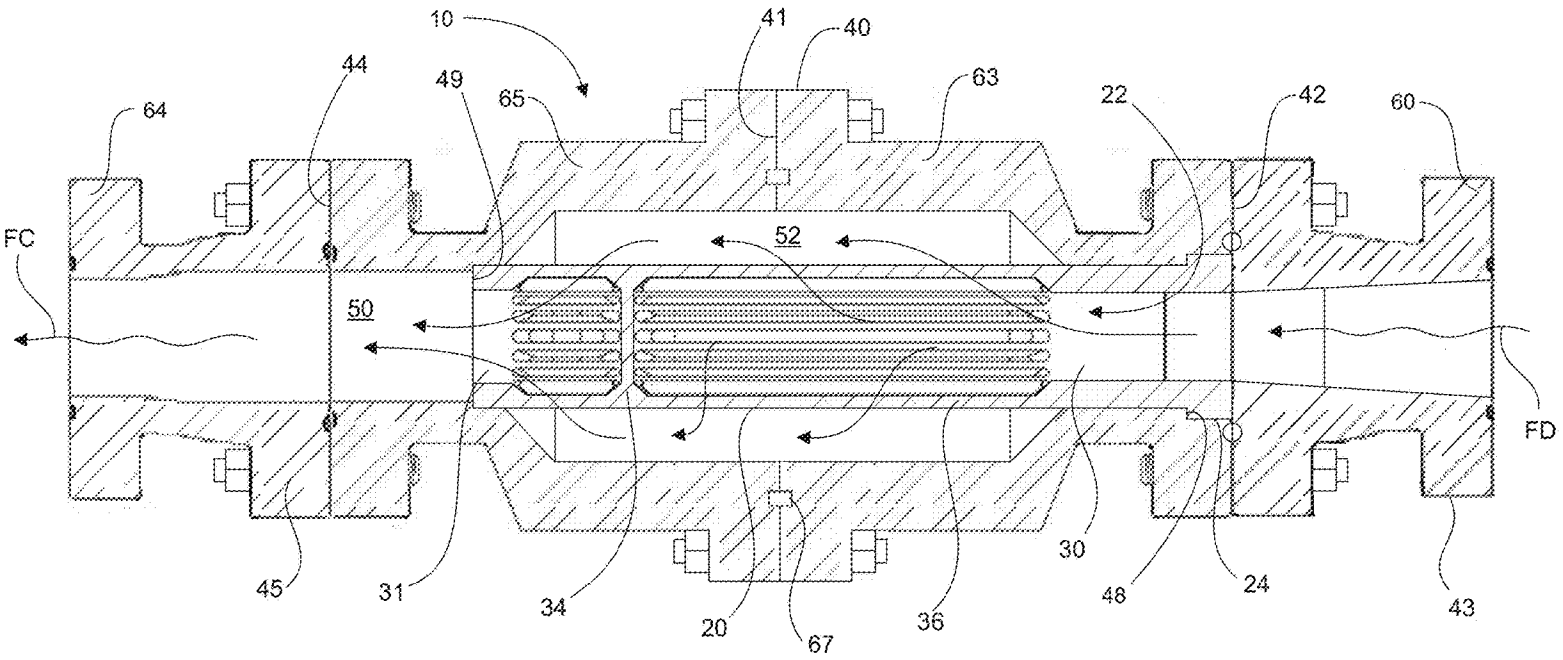
FIG. 2A is a side cross-sectional view of another embodiment of a debris catcher assembly, the illustrated embodiment having a two-part housing and elongated screen having a plurality of elongated screen openings and discharge ports.
Figure 2B:
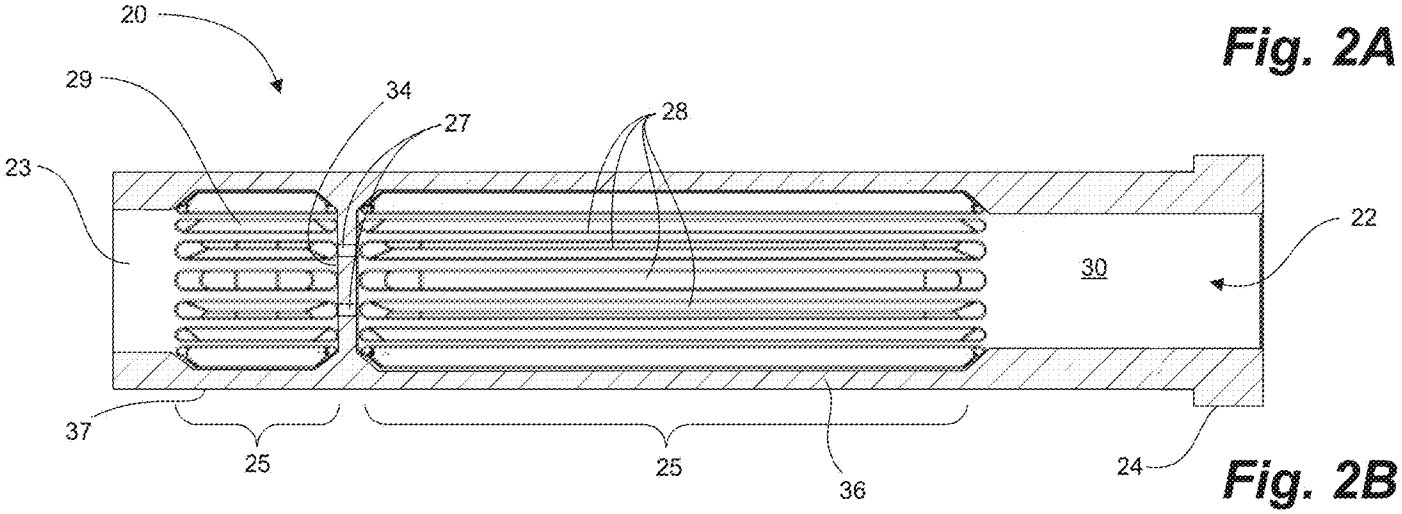
FIG. 2B is a side cross-sectional view of the screen of FIG. 2A.

Connection means 43,45 such as threaded or flanged connections can be located at the intake and discharge ends 42,44 respectively of housing 40, respectively, for coupling with upstream and downstream equipment as shown in FIGS. 2A and 2B. For ease of maintenance, quick connections 70 (FIGS. 1A, 1B) can be used to facilitate expedient removal of the debris catcher 10.

As shown in FIGS. 1A and 1B, in embodiments, the intake end 22 of the screen body 20 can be cantilevered from the housing 40. In other embodiments, as shown in FIGS. 2A and 2B, the screen body 20 can be supported by the housing 40 at both the intake and discharge ends 22,23 of the screen body 20 and/or at additional points intermediate the intake and discharge ends 22,23.

Returning to FIGS. 1A-1B, in embodiments wherein screen body 20 is only supported at one end within housing 20, the exterior surface of the screen 20 can have a retaining structure, such as a radial upset or lip 24 extending from the tubular wall 36 of the screen, for engaging with a corresponding recess in the upstream support structure 48, forming an annular shoulder extending inward from the wall of housing bore 50. Retaining structure 24 is preferably located adjacent the open intake end 22 of the screen in order to maximize the available screening area. In the depicted embodiment, retaining structure is an upset or lip 24 and upstream support structure is a shoulder 48. When housing 40 is connected to upstream equipment, lip 24 is sandwiched between shoulder 48 and the upstream equipment, thereby supporting screen body 20 within housing 40 and securing the screen against axial movement. In other embodiments, screen support structure 48 and retaining structure 24 can be complementary threads located on the housing bore 50 and tubular wall 36 of the screen body 20, respectively, and screen body 20 is supported by the engagement between the complementary threads instead of the lip 24 being sandwiched between shoulder 48 and upstream equipment.

Due to the erosive nature of the solids-containing fluid, it is a general objective to minimize or avoid local increases in fluid velocity. Therefore, the size of the screen bore 30 and openings 27,28 are maximized within the constraints of the particular environment. In some embodiments, openings 27,28 have a combined cross-sectional flow area equal to or greater than the cross-sectional flow areas of the fluid inlet and outlet lines and/or equipment, and the diameter of the screen bore 30 is also equal to or greater than the cross-sectional flow areas of the inlet and outlet lines. Further, the components upstream and downstream from the plug or debris-catcher assembly 10, such as piping, manifolds, and the like, can be manufactured to complement the screen to best screen solids and distribute the flow of fluid. In the embodiment depicted in FIGS. 1A-2B, screen openings 28 are of a slotted shape extending axially along the tubular wall 36 of the screen body 20.

The screen body 20 and housing 40 can be quite long, within the confines of structural limitations associated with the screen 20, in particular as the screen bore 30 fills with debris.

In the depicted embodiment of FIGS. 1A and 1B, a generally tubular inlet spool 60 and collar 70 are used to couple with housing 40 and retain screen body 20 therein to form fully assembled debris catcher 10. An upstream end 62 of inlet spool 60 is configured to couple with upstream equipment. Such a configuration allows convenient installation and removal of debris catcher 10 from the flowback system without requiring the screen body 20 to be unsecured. In other embodiments, housing 40 can couple directly with upstream equipment without inlet spool 60 and collar 70.

To assemble the debris catcher 10, as best shown in FIG. 1B, the discharge end 23 of the screen body 20 can first be inserted into the intake end 42 of the housing 40 with the inlet spool 60 removed, such that the lip 24 of the screen engages with the shoulder 48 of the housing and debris-receiving basket portion 25 opens upstream. Inlet spool 60, if used, can then be coupled to the housing 40 to secure screen body 20 against axial movement and fluidly seal the inlet spool 60 with housing 40. The assembled debris catcher 10 can then be connected to a desired location in the flowback system.

In use, debris-laden flowback fluid FD enters the debris or plug catcher 10 through the open end 22 of the screen. The end wall 34 of basket portion 25 forces fluid radially out of the openings 28 of the screen and into the annulus 52, while large solids are retained within basket portion 25. Cleaned fluid FC then flows from the annulus 52 out the discharge end 44 of housing 40 towards downstream equipment and components. In embodiments where the flow-restricting wall 34 also has openings 27, cleaned fluid FC can also flow out of screen bore 30 via said openings to discharge end 44.

The screen body 20 can be emptied of collected debris and cleaned by periodically removing the debris catcher 10 from the flowback system and separating the housing 40 from inlet spool 60. The screen body 20 can then be slid axially out of the housing 40 for solids removal and cleaning. In the case of FIG. 1B, due to the lip 24 and shoulder 48, the screen body 20 is removed from the intake end 22. Once cleaning operations are completed, the debris catcher 10 can be reassembled as described above and reinstalled in the flowback system.

The debris-catching assembly 10 described is advantageous compared to existing devices, as the in-line intake and discharge ends 42,44 of the housing 40 limits erosion compared to the orthogonal outlets of existing designs. Additionally, continuous openings, such as the slotted openings 28 shown, present substantially more cross-sectional flow area compared to the orifice designs of existing technologies, while still effectively catching solids. This mitigates the risk of plugging, and also allows fluid flow velocity to remain generally stable even in the unlikely event that the openings become plugged. So long as the unblocked cross-sectional flow area of the openings 28 remains at least about equal to the cross-sectional area of the inlet opening 22, fluid velocity will remain stable. As such, there is little risk of a jetting action that can occur as the orifices of existing designs become plugged. As the openings 28 provide a large amount of flow area, the screen body 20 can be relatively short while providing flow area equal to existing designs, allowing the debris catcher 10 to be significantly more compact than prior art designs, facilitating ease of transportation, assembly, installation, removal, and maintenance.

With reference to FIGS. 2A-6B, embodiments are provided wherein screen body 20 is supported at both its intake and discharge ends 22,23, thus allowing for longer implementations. In such embodiments, a discharge portion 26 can extend downstream from the end wall 34 of basket portion 26, terminating at a downstream open discharge end 23. Similar to the cantilevered embodiments described above, screen body 20 can have a retaining structure or a lip 24, for engaging with an upstream support structure 48 of housing 40. Housing 40 can further comprise a downstream support structure, such as a second shoulder 49, located adjacent the discharge portion 26 of the housing to receive the open discharge end 23 of the screen and support the screen body 20. In this embodiment, the housing is assembled from two portions and connected at a flanged interface 41. A first housing portion 63 is coupled to second housing portion 65 at interface 41 including a ring seal 67.

Figure 5A:
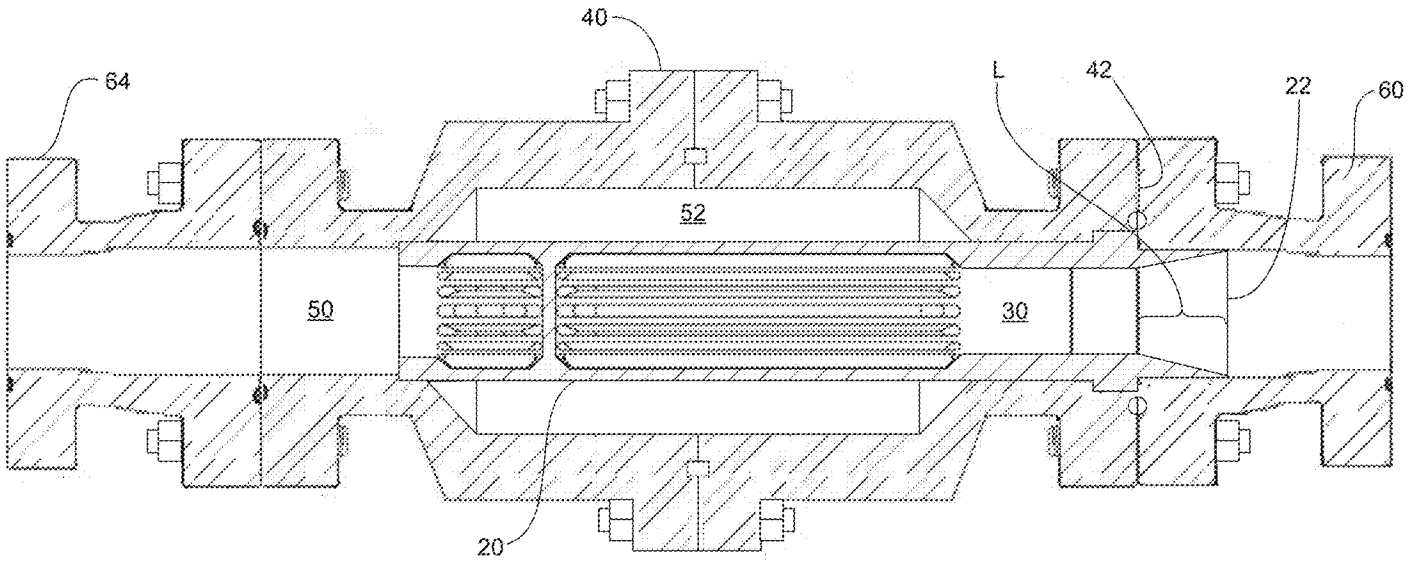
FIG. 5A is a side cross-sectional view of another embodiment of a debris catcher assembly having a screen, the intake end of which extends axially out of the housing and into an upstream connector spool.

Discharge portion 26 comprises aligning structure for generally aligning the screen body 20 with the intake and discharge ends 42,44 of the housing 40 and supporting the screen body 20 therein, as well as one or more discharge ports 29 to allow cleaned fluid FC to flow from annulus 52 to discharge end 44 and exit the housing 40 despite the downstream support structure 49. In an embodiment, as shown in FIG. 5A, discharge portion 26 can be similar to basket portion 25, having a tubular wall 37 with discharge ports 29 formed therein intermediate the end wall 34 and discharge end 23. The shape of ports 29 can be similar to openings 28 of basket portion 25. In an alternative embodiment, with reference to FIGS. 2F and 6A, discharge portion 26 can comprise three equidistant, circumferentially spaced prongs 32 extending axially downstream with a ring 33 located at or near the discharge end 23 and spanning the prongs 32 for providing structural support thereto. The end wall 34, prongs 32 and ring 33 define enlarged discharge ports 29 therebetween for allowing cleaned fluid FC to flow from the annulus 52 to the discharge end 44. Prongs 32 and/or ring 33 engage with the housing 40 for aligning the screen body 20 therewith and supporting the screen therein. As one of skill in the art would understand, many different structural configurations for discharge portion 26 are possible, so long as discharge portion 26 engages with housing 40 to support the screen body 20 therein, assists in aligning the screen body 20 with the housing 40, and allows cleaned fluid FC to flow from the annulus 52 to the discharge end 44 and out of housing 40. For example, in alternative embodiments, discharge portion 26 can comprise greater or fewer prongs 32, ring 33 can be omitted, and/or prongs 32 may be spaced in a non-equidistant manner. Further still, in some embodiments, discharge portion 26 can comprise a central prong 32 axially extending downstream and generally aligned with the central axis of the debris-catcher, the prong 32 terminating at the discharge end 23 and having one or more radial arms extending radially outwards for engaging with the housing 40 and/or retaining structure 49. For additional structural support, additional prongs 32 can connect the ends of the radial arms with end wall 34 and/or ring 33 can span the radial arms. Ports 29 are defined between the prongs 32, radial arms, and ring 33.

Housing 40 can be of integral construction or comprise several portions coupled together to facilitate more convenient installation and removal of a longer screen body 20. In the embodiments depicted in FIGS. 2A-6B, housing 40 comprises two portions 63,65 removably joined together at a connection such as a flanged inferface 41. As shown in FIGS. 2A, 4, 5A, and 6A, flanged inlet and outlet spools 60,64 can be provided to retain screen body 20 within housing 40 and connect the debris catcher 10 to the flowback system.

Figure 3A:
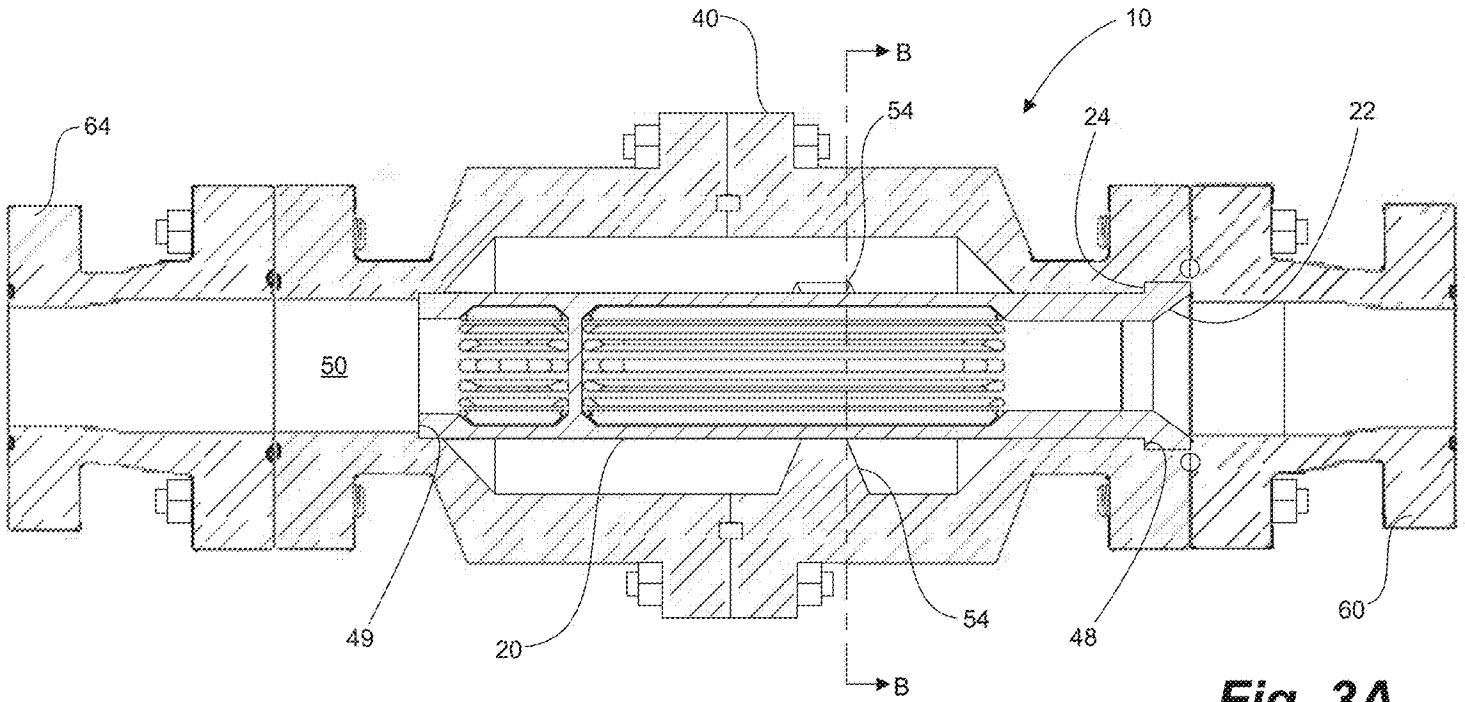
FIG. 3A is a side cross-sectional view of an alternative embodiment of a debris catcher assembly having three support arms extending inwards from the housing bore to support the screen.
Figure 3B:
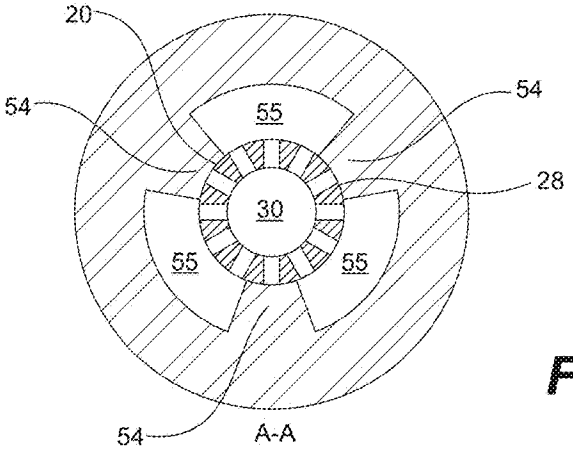
FIG. 3B is an axial cross-sectional view of the embodiment of FIG. 3A along line A-A.

As shown in the embodiment depicted in FIGS. 3A and 3B, for additional support, support arms 54 can extend from, and be angularly spaced about, the inner wall of housing bore 50 intermediate the intake and discharge ends 22,23 of the housing for engaging with the screen body 20. Flow channels 55 are located between support arms 54 to permit fluid flow in the annulus 52, and can be shaped and sized to mitigate local velocity increases. Preferably, flow channels 55 are aligned with openings 28,29 to reduce flow path disturbance and mitigate erosion.

The debris catcher 10 can be assembled in a similar manner to cantilevered embodiments described above. The screen body 20 can be inserted through the intake end 42 of the housing 40 such that the lip 24 of the screen engages with the upstream shoulder 48 of the housing and the downstream discharge end 23 of the screen is supported on the downstream shoulder 49 of the housing. If the housing 40 comprises multiple discrete portions, the portions can first be separated and secured together once the screen body 20 has been coupled with the intake end 42. The screen body 20 is now supported in the housing bore 50 and can be secured therein by connecting the inlet end 42 of the housing to inlet spool 60 or other upstream equipment. Discharge end 44 of the housing can similarly be secured to outlet spool 64 or other downstream equipment. The assembled debris or plug catcher 10 can then be connected to a desired location in the flowback system.

Embodiments that support screen body 20 at both ends are advantageous as screen body 20 can be sized to be as long as required to meet the requirements of the flowback operations, further enhancing the advantages discussed above. For example, a 6 foot long screen with a 4 inch diameter bore can capture up to 10 liters of solid debris. The length of the screen body 20 is primarily limited by the resultant weight, as screens that are too long can become too heavy to manage effectively. In the depicted embodiments, openings 28 are 0.375" wide and are substantially the length of the basket portion 25. The openings 28 total a flow area of 500 sq.in. Therefore, if a 3 inch inlet connection is used, the openings 28 could be 98-99% obscured while still maintaining a fluid flow velocity therethrough equal to entry velocity.

Figure 2C:
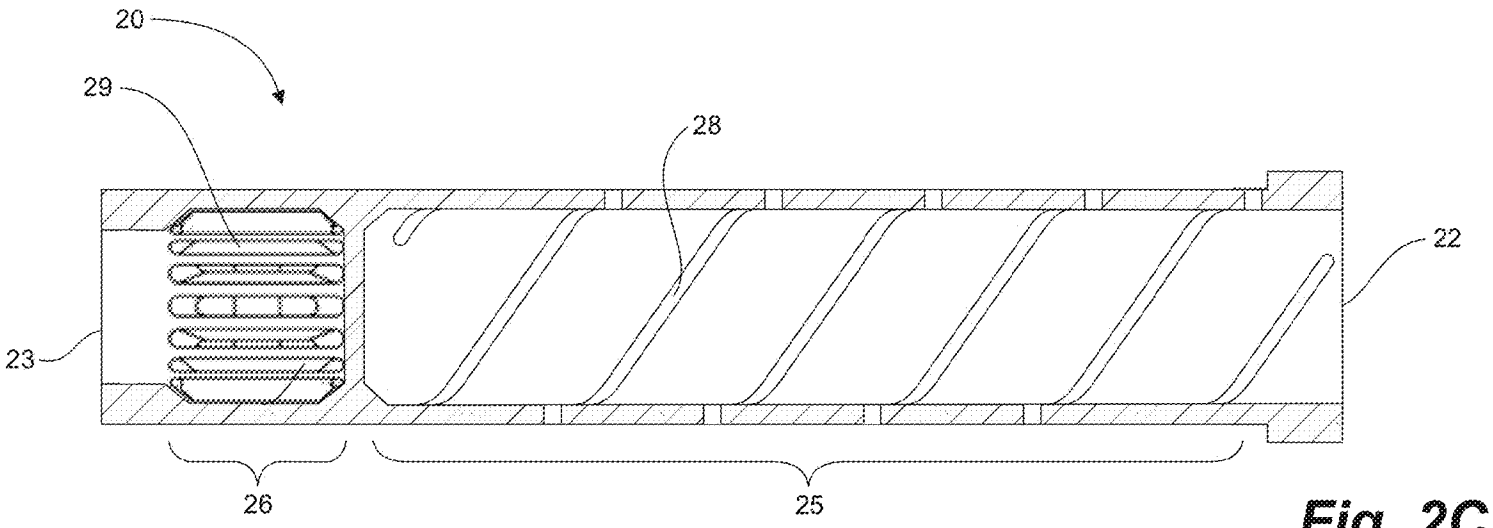
FIG. 2C is a side cross-sectional view of an alternative embodiment of the screen depicted in FIG. 2A illustrating a subset of a plurality of helical screen openings.
Figure 2D:
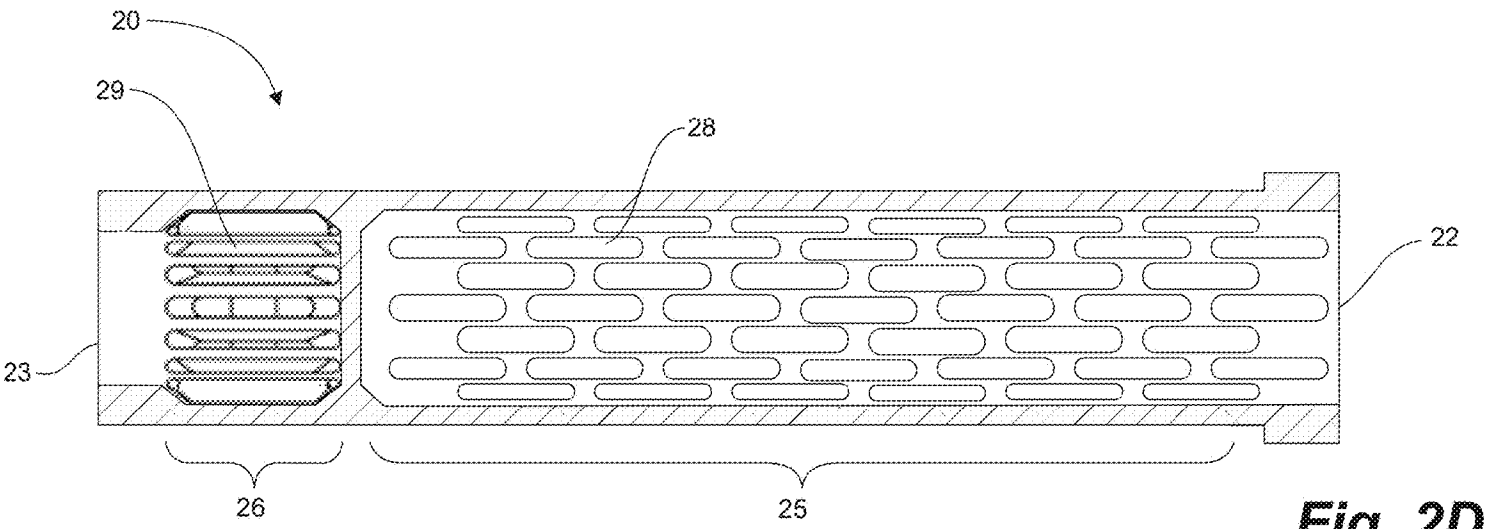
FIG. 2D is a side cross-sectional view of an alternative embodiment of the screen of FIG. 2A having a plurality of staggered, helically indexed, slot-shaped screen openings.
Figure 2E:
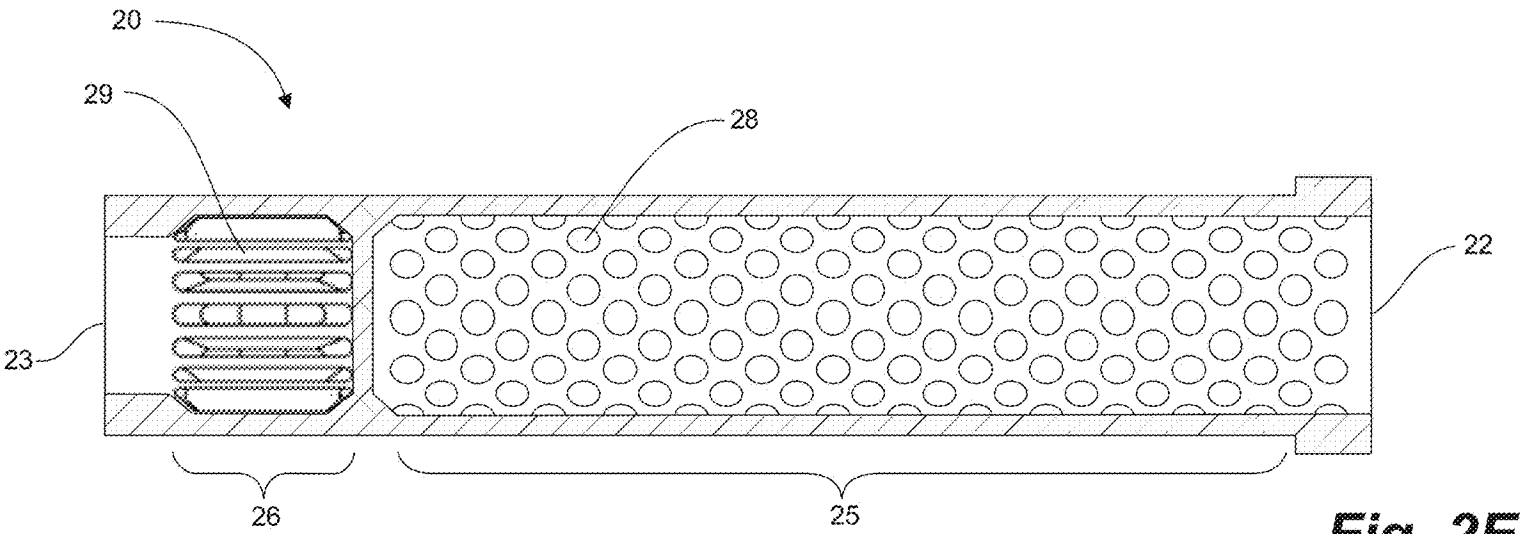
FIG. 2E is a side cross-sectional view of an alternative embodiment of the screen of FIG. 2A having a plurality of circular perforations.
Figure 2F:
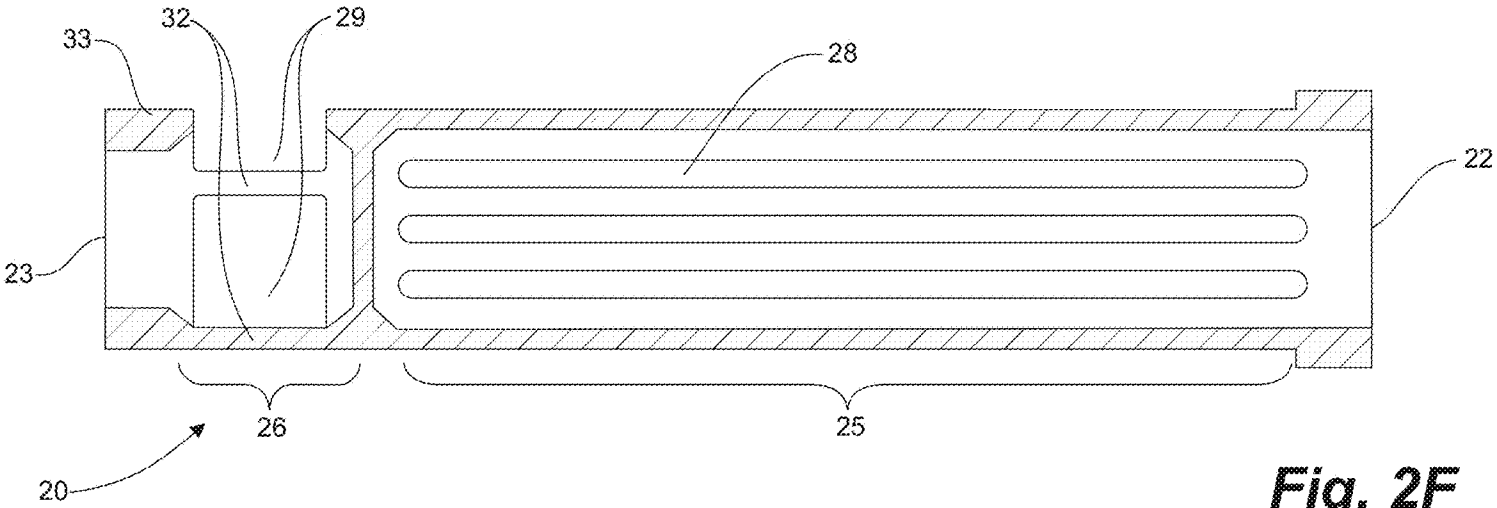
FIG. 2F is a side-cross-sectional view of an alternative embodiment of the screen of FIG. 2A wherein the discharge portion of the screen body comprises three large discharge ports located between three prongs.

Depending upon the length of the basket and discharge portions 25,26, slots 28 and ports 29 can be periodically supported with bridges to maintain dimensional tolerances. While FIGS. 1A-2B depict openings 28 as axially elongated slots, in other embodiments, as shown in FIGS. 2C-2E, screen openings 28 and/or ports 29 can comprise slots arranged in a helical pattern (FIG. 2C), a staggered slot pattern (FIG. 2D), or comprise a plurality of perforations (FIG. 2E). One of skill in the art would understand that various other configurations of openings 28 can be implemented without deviating from the substance of the invention, so long as the openings 28 screen solids and debris while providing sufficient combined cross-sectional flow area to mitigate increases in fluid velocity, and ports 29 allow fluid to flow from the annulus 52 to discharge end 44.

Figure 4:
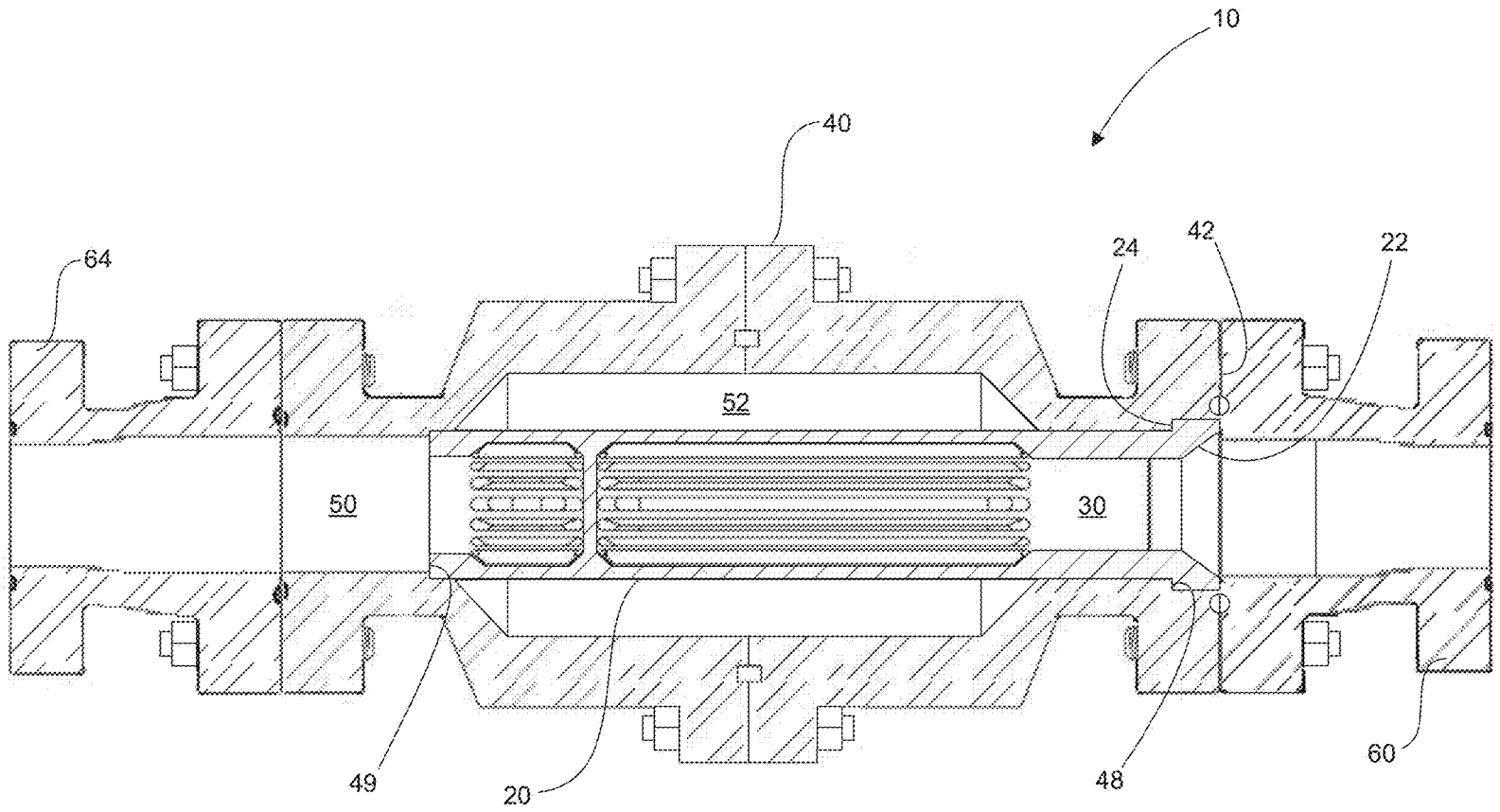
FIG. 4 is a side cross-sectional view of another embodiment of a debris catcher assembly having a screen with a beveled inlet at the intake end.

Referring now to FIG. 4, in an alternative embodiment, the screening bore 30 adjacent the open intake end 22 of the screen can be tapered such that the bore 30 gradually decreases in diameter from a larger than nominal diameter upstream and which decreases in diameter downstream to manage fluid velocity, reducing flow disturbance and erosion resulting therefrom.

Figure 5B:
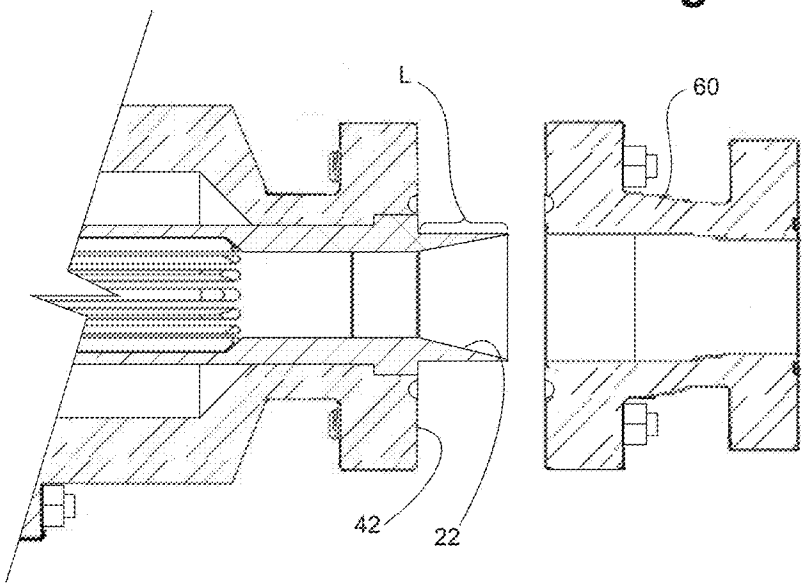
FIG. 5B is a side cross-sectional view of the embodiment of FIG. 4A, depicting the upstream connection being removed from the housing to expose the screen.

With reference to FIGS. 5A and 5B, in another alternative embodiment, the intake end 22 of the screen can extend axially out of and upstream past the intake end 42 of housing 40 and into the bore of connecting piping, by length L, for example into inlet spool 60. The intake end 22 of the screen is thereby located inside the bore of upstream equipment and components. Such an embodiment provides a more secure connection interface with upstream components and aids in convenient removal of the screen body 20 from housing 40. The extended intake end 22 can be combined with tapered bore embodiments, the intake end length L being tapered such as that described above to reduce flow disturbance.

The above embodiments have used an annular lip 24 or similar retaining structure to axially secure the screen body 20 within housing 40. This limits insertion and removal of the screen 20 to one end of the housing 40 and to one axial direction, shown in the figures as via the intake end 42.

Figure 6A:
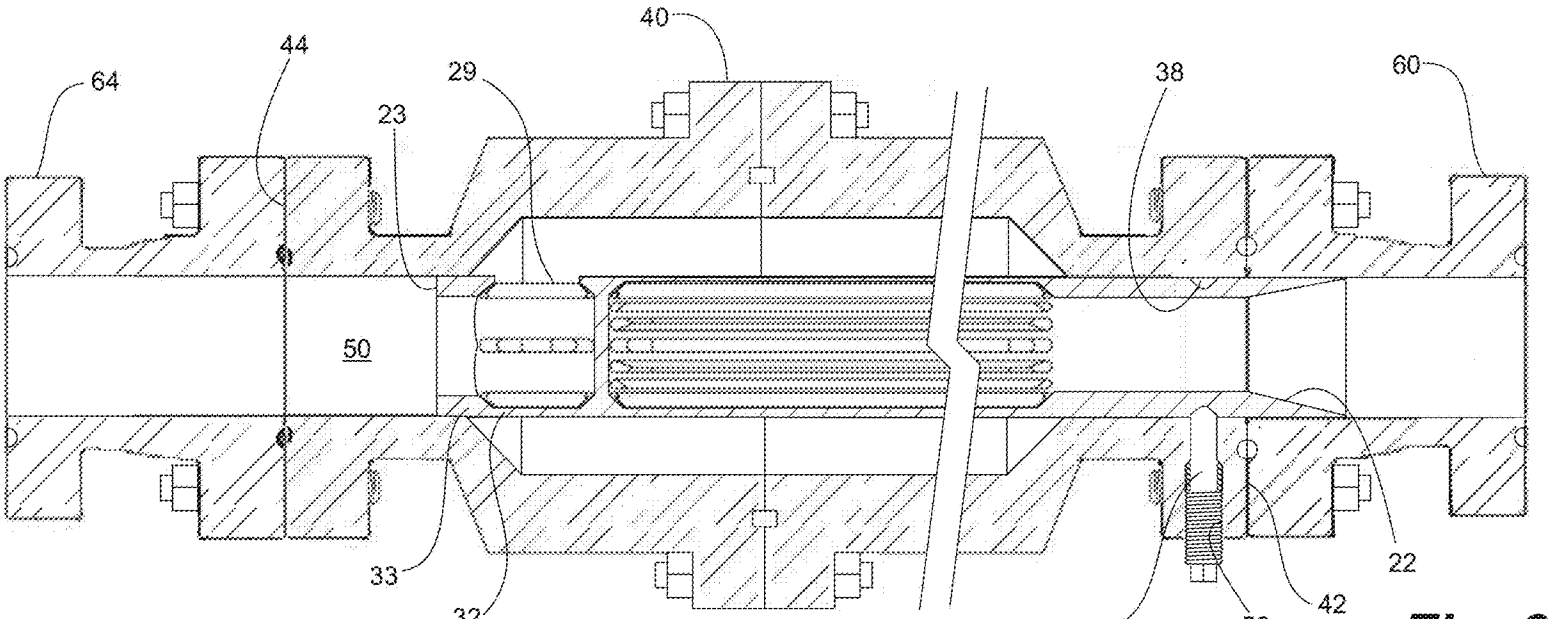
FIG. 6A is a side cross-sectional view of a debris catcher assembly having a screen with a radial recess being retained in the housing by a holddown screw or bolt. Further, the screen is varied to have a minimal support portion extending from the exit portion of the screen for minimal flow restriction as the fluid leaves the annulus and exits the housing outlet.
Figure 6B:
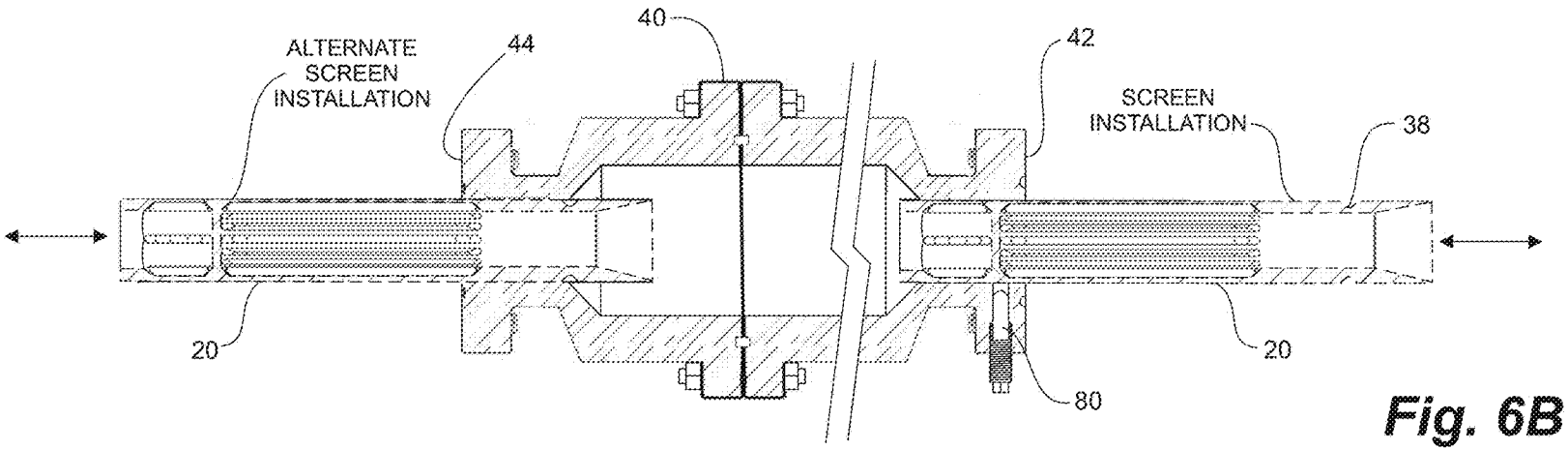
FIG. 6B is a side cross-sectional view of the debris catcher assembly of FIG. 5A, depicting the holddown bolt being released to allow the screen slide axially in and out of the housing.

In other embodiments, with reference to FIGS. 6A and 6B, alternative retaining mechanisms can be used to secure screen body 20 within housing 40 and prevent axial movement of the screen while allowing the screen to be inserted or removed in both axial directions. For example, the screen body 20 can be retained within housing 40 by one or more holddown screws, bolts, or other releasable fasteners 80 supported by the housing 40 and adjustable to enter the housing bore 50 through generally radially extending ports 56 formed in the housing and engage with one or more complementary recesses, annular grooves 38, or the like located on the exterior of the tubular wall 36 of the screen body 20. In such embodiments, retaining structure 24 and upstream and downstream supporting structures 48,49 can be omitted, thereby providing a uniform-diameter screen tubular wall 36 and housing bore 50. The diameter of screen body 20 can be sized for ease of axial insertion and removal from the intake or discharge ends of the housing 42,44. Thus, screen body 20 is still supported by the intake and discharge ends 42,44 of the housing, but is axially secured by fastener(s) 80. In the depicted embodiment, annular groove 38 formed in the tubular wall 36 of screen body 20 adjacent the screen's open intake end 22 and a radial port 56 formed in a corresponding location of housing 40 are configured to receive a holddown screw 80 through port 56 at the housing's intake end and axially retain screen body 20 within housing bore 50.

To assemble embodiments of debris catcher 10 wherein screen body 20 is within housing 40 by fasteners 80, the screen can be inserted into the housing via either the intake or discharge end 42,44 and positioned such that the screen intake and discharge ends 22,23 are supported by the housing intake and discharge ends 42,44, and the annular groove 38 of the screen can are aligned with corresponding ports 56 of housing 40. Fasteners 80 can be inserted into said ports 56 to engage the groove 38.

Figure 6C:
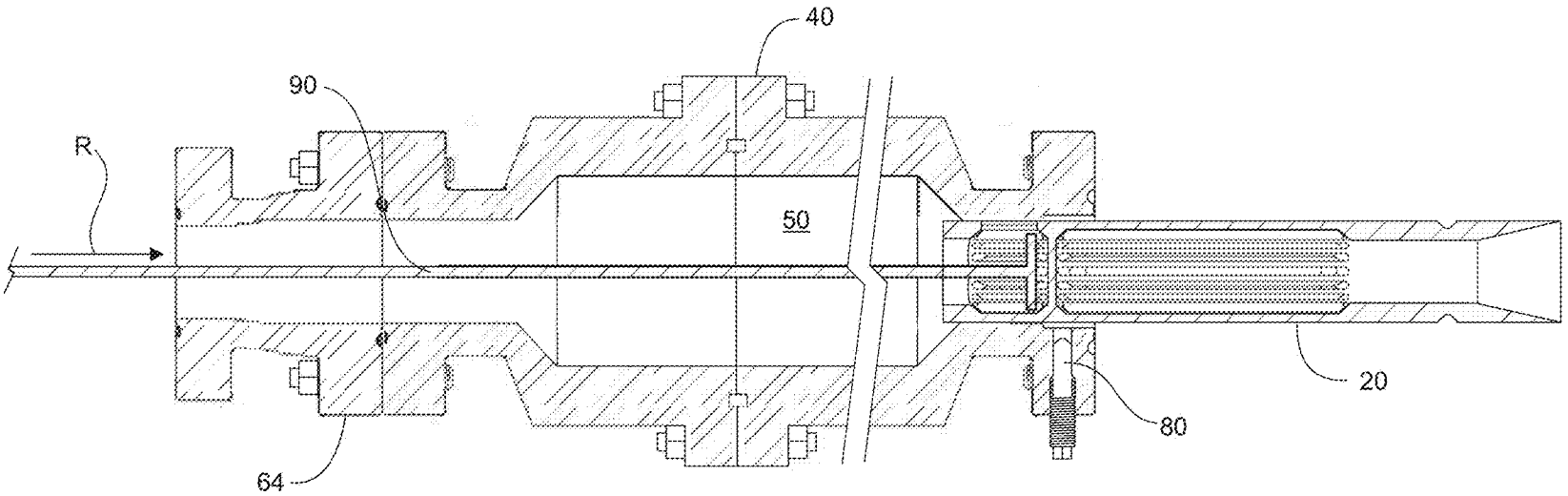
FIG. 6C is a side cross-sectional view of the debris catcher assembly of FIG. 5B illustrating maintenance using an installation and removal tool to remove a screen from the housing.
Figure 6D:
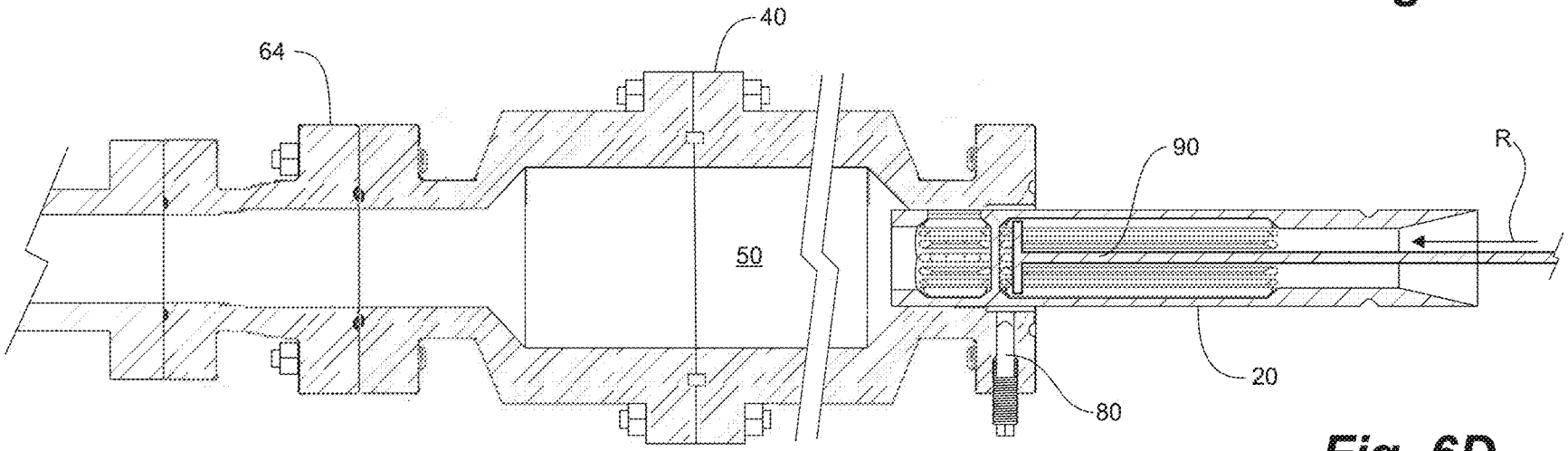
FIG. 6D is a side cross-sectional view of the debris catcher assembly of FIG. 5B illustrating maintenance using an installation and removal tool to install the screen into the housing.

As shown in FIGS. 6C and 6D, an installation and removal tool 90, such as an elongate rod, can be used to both axially push, and could be manipulated to pull, screen body 20 into and out of housing 40. The tool 90 can also support the temporarily unsupported portion of the screen body 20 during the installation and/or process.

Figure 7:
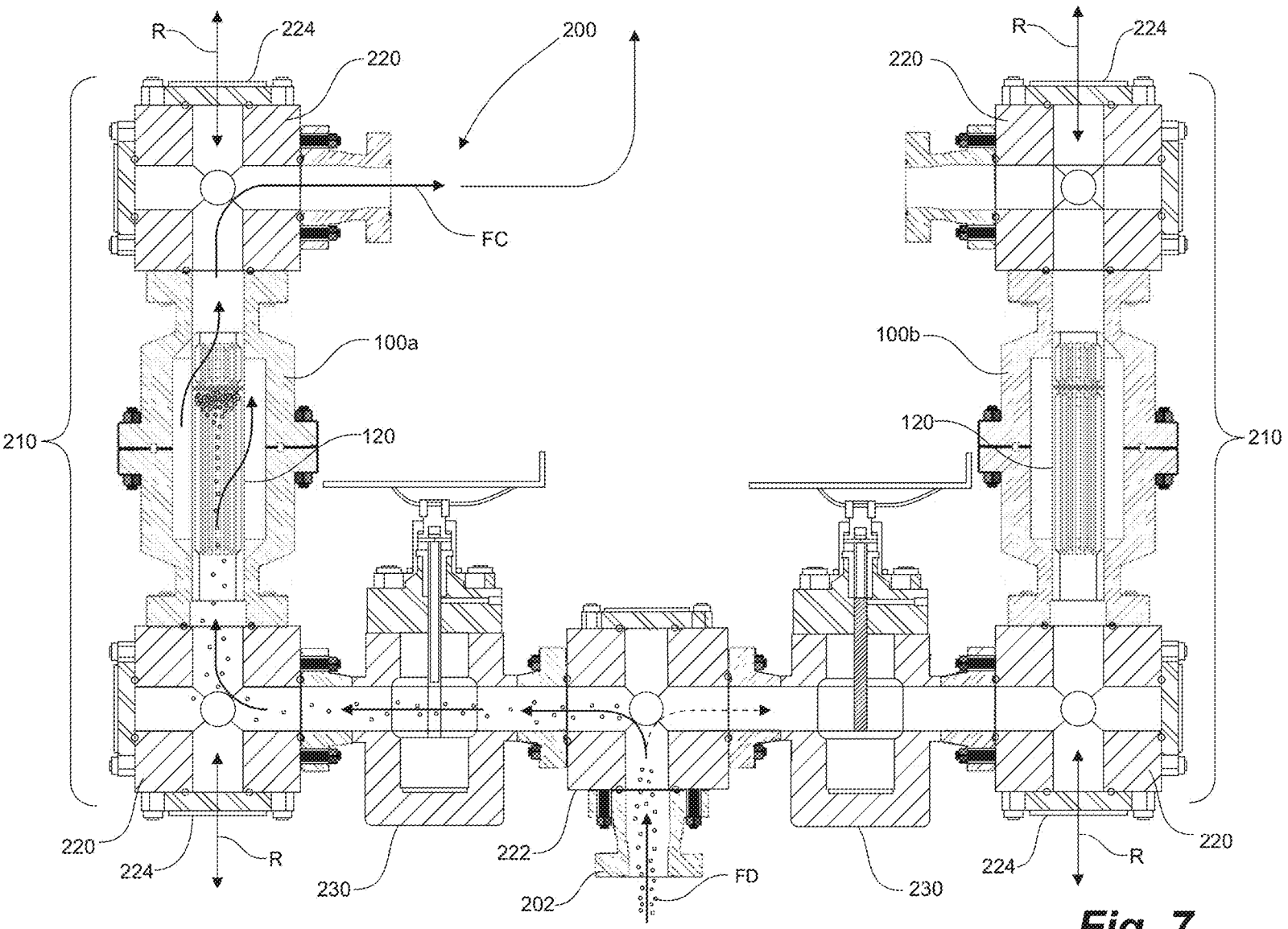
FIG. 7 is a schematic of a dual debris catcher manifold system.
Figure 8:
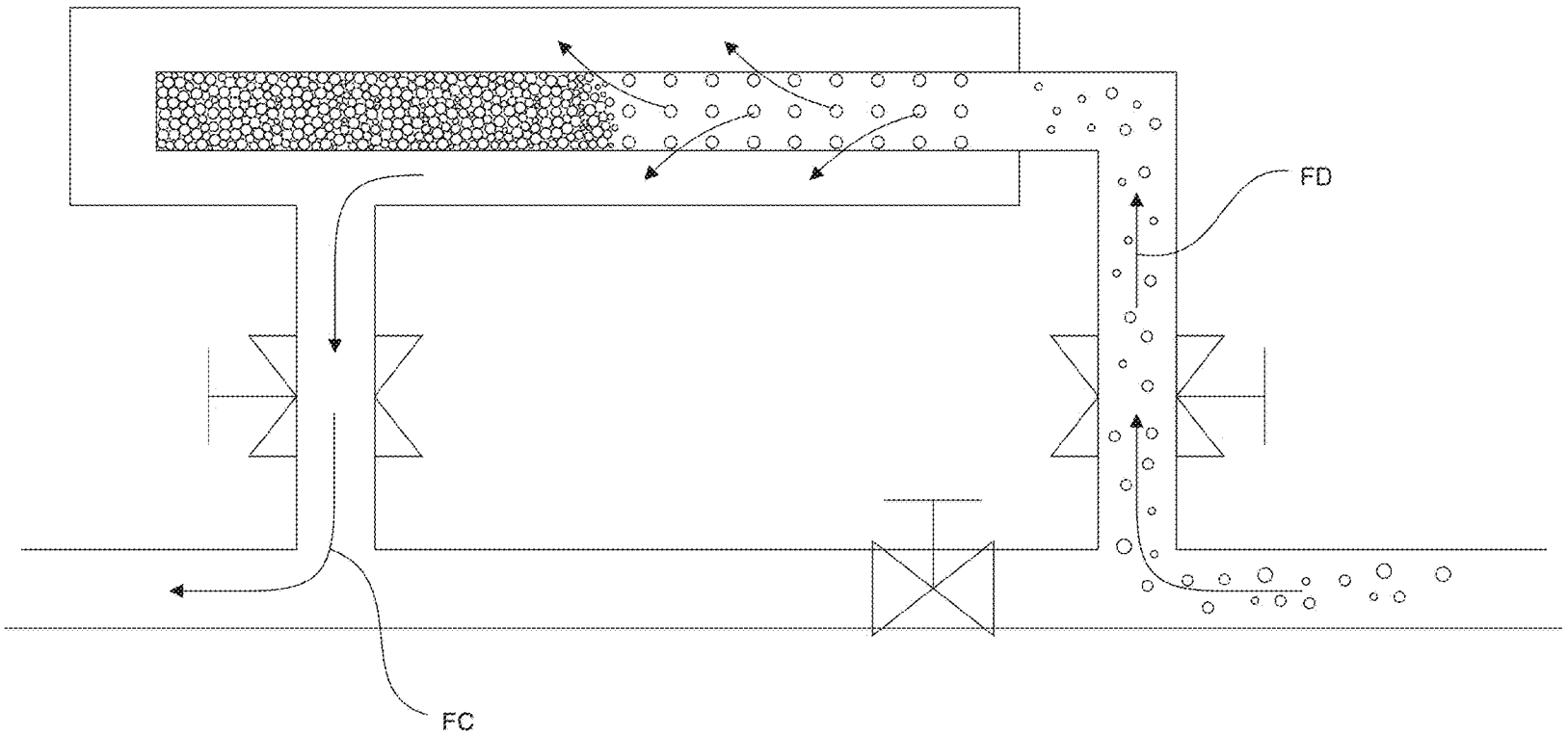
Fig. 8 PRIOR ART
FIG. 8 is a schematic of a prior art arrangement using a perforated screen for debris removal from an annular portion.

With reference to FIG. 7, a manifold screen system 200 for dual screens 20,20 can have two debris-catcher assemblies 10,10, each housed in a bypass 210,210. Each debris-catcher assembly 10,10 comprises a screen housing 40 fit with flow blocks 220,220 fluidly connected to the intake and discharge ends 42,44 of the housing. Housings 40,40 and flow blocks 220,220 are in-line and preferably arranged in space to ensure access to at least one end of the screens 20,20. The flow blocks 220,220 are fit with removable blanking flanges 224 on the flow block ports in line with the screen axes to enable access to the screens 20,20 from either end of the housings 40,40 for replacement and/or maintenance of the screens, such as, illustrated in FIGS. 6C, 6D and 7, by arrows R.

The manifold system 200 has an inlet 202 that enters a cross flow block 222, flow blocks herein being a universal four port fitting having specifications suitable for handling fracturing fluids, both for handling the material characteristics of the fluid, such as its abrasive nature, and the well pressures. The flow block is straddled by block valves 230,230 which can selectively direct flow to one of the screens 20,20, thereby enabling continuous flowback to one screen 20 while the other screen 20 is out of service, for example due to replacement or maintenance procedures. Alternatively, block valves 230,230 can both be open to allow flowback fluid FD to flow to both screens 20,20.

As would be apparent to one skilled in the art, manifold screen system 200 can comprise more than two debris-catcher assemblies 10 and have block valves 230 to selectively permit fluid flow to individual or multiple debris catchers 10.

What is claimed is:

1. A debris catcher for removing debris from fluids, comprising:

a generally tubular housing having an intake end, a discharge end, a housing bore extending axially therethrough, the intake end having a first inner diameter and the discharge end having a second inner diameter;

a tubular screen supported axially inside the housing bore and forming a flow annulus between the housing and the screen, the flow annulus in fluid communication with the discharge end, the screen having an outer diameter and comprising:

an upstream portion supported adjacent the intake end of the housing, the upstream portion having a tubular wall having a screen bore within, and having an intake end open to the housing's intake end and a downstream end wall;

a discharge portion extending downstream from the end wall, the discharge portion being supported adjacent the discharge end of the housing;

the tubular wall having a plurality of screen openings for establishing fluid communication between the screen bore and the flow annulus, wherein the screen openings pass fluid therethrough whilst retaining wellbore debris within the screen bore, a cumulative flow area of the screen openings being greater than a cross-sectional flow area of the screen's intake end; and wherein the flow annulus and the discharge end of the housing are in fluid communication through the discharge portion.

2. The debris catcher of claim 1 wherein the screen's upstream portion further comprises a retaining structure at the screen's intake end to secure the screen against axial movement within the housing bore.

3. The debris catcher of claim 2 wherein the retaining structure comprises an upset at the screen's intake end for engaging a corresponding shoulder of the housing is intake end.

4. The debris catcher of claim 2, wherein the retaining structure comprises a lip extending radially outwards from the tubular wall of the screen located adjacent the screen's intake end, and an annular shoulder about the housing's intake end, the lip engaging the shoulder for axially retaining the screen in the housing's bore.

5. The debris catcher of claim 2, wherein the retaining structure comprises one or more annular grooves formed in the tubular wall of the upstream portion, one or more complementary holddown ports extending generally radially through the housing's intake end, each holddown port configured to receive a fastener to releasably engage the one or more annular grooves, such that the screen is removably secured axially within the housing bore.

6. The debris catcher of claim 5, wherein the screen is receivable axially through both the housing's intake end and discharge end.

7. The debris catcher of claim 5, wherein the outer diameter of the tubular screen is substantially uniform along a length of the screen, and is substantially equal to the first and second inner diameters.

8. The debris catcher of claim 1, wherein the discharge portion comprises a downstream support structure and one or more discharge ports for establishing fluid communication between the flow annulus and discharge end.

9. The debris catcher of claim 8, wherein the discharge portion comprises a tubular wall having the one or more discharge ports formed therethrough.

10. The debris catcher of claim 8 wherein the downstream support structure is one or more prongs extending axially downstream from the end wall, the one or more discharge ports being formed between the one or more prongs.

11. The debris catcher of claim 10 the discharge support structure further comprising a ring circumferentially spanning the one or more prongs, the ring supported in the housing discharge end.

12. The debris catcher of claim 1, wherein axes of the housing's intake and discharge ends are generally aligned with an axis of the tubular screen.

13. The debris catcher of claim 1, wherein the plurality of screen openings in the upstream portion are elongate slots in the tubular wall.

14. The debris catcher of claim 1, wherein the screen's end wall has a second plurality of openings for establishing communication between the screen bore and discharge end of the housing, the second plurality of openings retaining debris while allowing fluids to flow thereby.

15. The debris catcher of claim 1, wherein the housing comprises at least a first housing portion and a second housing portion, removably coupled axially with each other to form the housing bore.

16. The debris catcher of claim 1, further comprising one or more circumferentially spaced supports extending between the housing and the screen, located intermediate the housing's intake and discharge ends for supporting the screen.

17. The debris catcher of claim 1 wherein the screen's bore at the screen's intake end is tapered to decrease in diameter from the upstream to the downstream.

18. The debris catcher of claim 17 wherein the screen's intake end extends axially out of the housing's intake end.

19. A manifold screen system for removing debris from fluids returned from a wellbore, comprising:

an inlet flow block having a central bore in communication with two or more auxiliary bores;

at least two debris catchers of claim 1, each debris catcher fluidly connected to one of the auxiliary bores of the inlet flow block; and isolated between two valves, for selectively permitting fluid flow to one or more of the at least two debris catchers.

20. The screen system of claim 19, wherein the at least two debris catchers are spatially arranged to permit axial access to at least the intake end or the discharge end of each debris catcher for insertion or removal of a screen supported therein.

21. The screen system of claim 19, wherein a third inner diameter of the auxiliary bores is substantially equal to the outer diameter of the tubular screen and the first and second inner diameters, and the at least two debris catchers are spatially arranged to permit axial access to both the intake end and discharge end of each debris catcher for insertion or removal of a screen supported therein.

* * * * *